US005950865A

United States Patent [19]

Menes

[11] Patent Number: 5,950,865

[45] Date of Patent: Sep. 14, 1999

[54] DISPOSABLE MICROSCOPE SLIDE DISPENSER

[76] Inventor: Cesar Menes, 12905 Wolverton, Cerritos, Calif. 90703

[21] Appl. No.: 09/002,444

[22] Filed: Jan. 2, 1998

[51] Int. Cl.[6] ..... B65H 1/08

[52] U.S. Cl. ..... 221/232; 221/268

[58] Field of Search ..... 221/232, 268, 221/226, 279, 259, 178, 190, 258, 281

[56] References Cited

U.S. PATENT DOCUMENTS 5,335,822 8/1994 Kasper ..... 221/232

OTHER PUBLICATIONS

Microscope Slide Dispenser Model M6180; Allegiance Scientific Products Catalog, 1997, p. 735.

Microscope Slide Dispenser Model M6183–1; Allegiance Scientific Products Catalog, 1997, p. 735.

Microscope Slide Dispenser Model M6182–1; Allegiance Scientific Products Catalog, 1997, p. 735.

*Primary Examiner*—Kenneth W. Noland

*Attorney, Agent, or Firm*—Charles H. Thomas

[57] ABSTRACT

A microscope slide dispenser is formed with a base having a slide dispensing mechanism and a disposable, plastic slide case that is removably mounted atop the base. Positioning members on the base interact with corresponding members on the case to properly position the slide upon a seating platform. A slide carrier has a finger that projects upwardly from the base and engages the rear edge of the lowermost of a plurality of microscope slides vertically stacked in the case. The case is provided with carrier finger opening and a slide dispensing slot. Operation of the dispensing mechanism engages the carrier finger behind the lowermost slide and pushes it out of the slide case through the slide dispensing slot. The carrier is spring biased so that the slide engaging finger returns to a slide engaging position behind the next slide, which drops down in place of the slide ejected. Once all slides have been ejected from the case, the case is discarded.

19 Claims, 10 Drawing Sheets

DISPOSABLE MICROSCOPE SLIDE DISPENSER

BACKGROUND OF THE INVENTION

1. Field of the Invention

The present invention relates to a disposable slide shipping and storage case for microscope slides and to a means for dispensing the slides from such a case.

2. Description of the Prior Art

Microscope slides are thin, elongated, rectangular plates of glass on which fluid, tissue smears, or other biological specimens are typically mounted for examination under a microscope. These slides are manufactured by the millions and are generally sold in conventional shipping and storage cases which are shallow cardboard boxes, in which the slides are placed on edge to form a horizontally extending stack filling the bottom tray of the box from front to back. In a conventional slide shipping and storage box of this type, the slides are oriented in a generally vertical disposition with the longitudinal side edge of each slide resting on the bottom of the tray. A close-fitting top fits snugly over the filled bottom box tray, and the box is sealed in a wrapper to prevent contamination during transit to the end user and during storage prior to use.

Due care is usually taken by the slide manufacturer in preparing and packaging the slides to prevent them from being exposed to dust, fungal and bacterial spores, and other contaminants during shipping and storage. However, once the box is opened at a laboratory site, removal of the slides by the end user is most often accomplished merely by grasping them and pulling them from the box. Also, the slides are normally used one at a time and the open box with the stack of slides in it is typically left on the table top until it is empty, thereby exposing the slides remaining in the box to the laboratory environment.

The conventional practice of leaving unused slides in an open box exposes them to contamination. For example, the slides in the open box are exposed to aerosol droplets from sprays used in the laboratory, to medical specimen fluids, and to various chemicals and liquids normally used in laboratories, such as fixative compounds sprayed on specimens being prepared on other slides nearby, disinfectants, water sprays, etc., as will as dust and other airborne materials. Furthermore, even though slides are normally handled by the edges, it is difficult to avoid leaving finger marks on the slides in the form of deposits of body oils and other substances carried on the fingers of the laboratory personnel.

Not only does such handling of the slides promote their contamination especially if the user's hand is not covered by a sterile glove—but it also subjects the laboratory personnel to the risk of cuts. Due to the presence of water droplets, moisture, disinfectants and other liquids in the laboratory, the slides will tend to stick together. In attempting to separate them a user's fingers can easily slip along the sharp edges of the glass slides when force is exerted to pull them apart. This often occurs when the slides contact moisture because the smooth glass surfaces in a stack of slides tend to adhere together. As a laboratory technologist attempts to separate the slides, accidental cuts to the skin can occur rather easily. Economy is a key factor in the manufacture of microscope slides. Therefore, the slide edges are normally not rounded or beveled, so that very little force is required to cause a finger cut. Needless to say, skin cuts are undesirable in the septic environment of medical laboratories as infection may readily occur.

Also, slides are normally grasped by the edges between a thumb and index finger placed against opposite edges of the slide to remove it from a box to mount a specimen, and to place the completed slide under a microscope. This technique is employed to minimize contamination. However, the practice of handling slides in this manner increases the likelihood of cuts by the edges of the slides.

Because economy of production has been so important, and since packaging of microscope slides in cardboard boxes has become so universal, little attention has been given to alternative forms of packaging and dispensing microscope slides. Nevertheless, there is a definite need for a system by which microscope slides may be dispensed as needed from a protected container in a manner which minimizes the possibility of cuts and contamination.

Efforts have been made to solve or at least minimize problems in handling microscope slides by providing microscope slide dispensers. Conventional dispensers which are commercially available eject slides one at a time from within a protected enclosure. One such conventional dispenser is illustrated in the 1997 Allegiance Scientific Catalog as Model number M6180. This device, which is made of sturdy sheet steel, has a rectangular container into which a vertical stack of microscope slides can be introduced through a removable side panel such that the lowermost slide in the stack rests upon the bottom of the container. An ejection mechanism is built into a bottom compartment of the container. The ejection mechanism is actuated by an external lever arm mounted on one side of the slide container. Manual rotation of the lever arm through an angle of approximately ninety degrees advances an ejector element under the lowermost slide in the stack. The ejector element has an upstanding lip which engages a rear edge of the lowermost slide and pushes the opposite end of the slide through a slot in the side of the container. The protruding end of the slide can then be manually grasped and the rest of the slide is then pulled from the dispenser. The next lowest slide then drops to the bottom into position for ejection when the lever is returned to its initial position.

While this conventional microscope slide dispenser works for its intended purpose, its design calls for rugged construction in order to withstand the repeated compression of an internal spring element. The device is therefore fabricated of steel. While durable and reliable, this device is expensive. Consequently, its use has been limited when compared with the extent of use of the typical process of removing slides by hand, one by one, from an open cardboard box. Moreover, the entire stack of slides still must initially be removed from its original cardboard box by hand and then hand loaded into the dispenser. Therefore, the risks of contamination and finger cuts still exist.

Another conventional microscope slide dispenser is sold as the Scienceware slide dispenser, model M6183-1. In this dispenser the lowermost slide in a stack rests upon a cylinder which can be turned by means of an external knob. This device ejects the lowermost slide sideways and edgewise from the stack through a slot in the housing containing the stack due to frictional force between the bottom slide and the rotating cylinder surface. This dispensing device has been found to be somewhat unreliable as the cylinder surface undergoes wear with use, which diminishes the friction exerted by the rotating cylinder. When worn, the cylinder tends to merely slip past the bottom slide in the stack. Also, this dispenser too must be hand loaded manually with slides taken from a factory package.

A need has existed for a simple, less expensive device in which microscope slides may be packaged, or into which they may be easily inserted, and from which they may be removed individually with minimized exposure to contamination of the slide surfaces and a smaller likelihood of finger cuts. In particular, a need has existed for a slide dispenser which is of sufficiently low cost so as to be suitable for use as the original factory packaging for the slides, thereby eliminating the need to transfer the slides to a separate dispenser at a laboratory or other end user location. Optimally, the slide dispenser should be sufficiently simple in design and low in cost so as to be discardable or recyclable after a single use. Factory packaged slides could then be dispensed one at a time for immediate use in the laboratory, with no intermediate handling or exposure of the slides to contamination.

SUMMARY OF THE INVENTION

The present invention provides a container for microscope slides which is disposable and which may be combined with an ejection device by which individual slides, held within the container, may be selectively ejected therefrom. The means by which the slides are held within and ejected from the container, and the configuration of the slide container itself vary, but include the several principal embodiments of the invention described herein. In all cases, however, the slide case is formed as a permanently sealed microscope slide shipping and storage box or container which is positionable atop a base containing the slide carrier mechanism and which requires and permits no handling of the slides until such time as each slide is individually ejected for use.

A principal advantage of the microscope slide dispenser of the present invention lies in the use of a slide storage box that is constructed and configured so that it may serve not only as a container for transporting and storing microscope slides, but also as a replaceable slide cartridge for the dispenser. The slide case of the invention is configured with an actuator access opening in the floor of the case and with a slide ejection slot in a side wall of the case immediately adjacent to the floor. The lowermost slide of the stack of slides located within the slide case may be engaged by the dispenser mechanism and ejected from the slide case through the slide ejection slot without having to transfer the slides from boxes in which they are shipped and stored to a separate cartridge or feed device forming a permanent part of the dispenser apparatus. Rather, the slide case is removably mounted atop the base and is discarded or recycled after all of the slides have been ejected therefrom.

One object of the present invention is to provide a microscope slide dispensing apparatus that eliminates the need for handling slides or otherwise exposing the slides to ambient air or laboratory fluids prior to the time that each slide is needed for a specific purpose. The slide dispensing apparatus of the invention thereby serves to protect slides in a laboratory or other workplace to a far greater extent than has heretofore been possible.

Another object of the invention is to greatly reduce the hazards of cuts from separating moisture-bonded slides that are so often encountered in the normal, conventional handling of slides by laboratory personnel. Unlike prior systems that require the manual transfer of slides from a shipping or storage box to a dispensing apparatus, the use of a microscope slide dispenser according to the invention totally eliminates manual handling of the slides until the slides are actually dispensed from their shipping and storage case for use by laboratory personnel. The elimination of handling of the slides prior to actual use of each individual slide greatly minimizes the risk of cuts in a laboratory.

In one broad aspect the present invention may be considered to be an improvement in a microscope slide dispenser. The dispenser has a base with a dispensing mechanism including a slide engaging finger that projects upwardly from the base and which is moveable relative to the base along a slide ejection path. A slide case is located atop the base. A plurality of smooth, flat, microscope slides are vertically stacked within the slide case.

According to the improvement of the invention, the slide case is disposable and seats upon and is removable from the base. The slide case is formed with confining floor, roof and side wall members that are permanently sealed together to encapsulate the slides within the slide case. The lowermost of the flat slides is in contact with the floor. Also, the slide case floor has an actuator access opening therein to receive the slide engaging finger in its movement along the slide ejection path. A slide ejection slot is defined within one of the sidewall members immediately adjacent to the floor member. The slide ejection slot lies in alignment with the slide ejection path. The slide engaging finger is thereby engageable with the lowermost of the slides to eject it from the case through the slide ejection slot as the slide engaging finger moves along the slide ejection path toward the slide ejection slot.

The slide case encloses a slide cavity. When the slide ejection slot is formed in one of the narrower walls of the case and the slide ejection path extends parallel to the wider case walls, the slide case is preferably provided with a divider. The divider extends parallel to and is located remote from the slide wall member in which the slide ejection slot is formed. The divider delineates the slide cavity into a slide storage compartment bounded on one side by the slide wall in which the slide ejection slot is formed and a return compartment remote from the slide wall in which the slide ejection slot is formed.

The dispensing mechanism is also preferably provided with a spring that biases the slide engaging finger toward a return position beneath the return compartment where the finger can engage the rear edge of the lowermost slide remaining in the slide compartment. Operation of the dispensing mechanism causes the slide engaging finger to move toward the slide ejection slot, pushing before it the lowermost slide in the vertical stack of slides in the case. Once the lowermost slide has been pushed out of the case through the slide ejection slot so that it protrudes well beyond the slide case, a laboratory technologist grasps the emerging slide by its edges and pulls it free. The actuating mechanism of the slide dispenser is released, therefore allowing the spring to return the slide engaging finger to its return, slide engaging position beneath the return compartment. The weight of the slides above cause the next sequential slide from the bottom in the vertical stack to drop as the next lowermost slide into the ejection position.

In another broad aspect the invention may be considered to be a combination of elements. This combination includes a microscope slide dispenser base defining a horizontal seating platform having a carrier finger opening therein. A dispenser mechanism is mounted on the slide dispenser base and includes a carrier that has a slide engaging finger that projects upwardly from the base through the carrier finger opening in the seating platform. The carrier is movable in longitudinal reciprocation along a horizontal, linear slide ejection path. The combination also includes a plurality of smooth, flat, microscope slides vertically stacked one atop another.

Another element of the combination is a disposable slide shipping case having side walls, a roof, and a floor which define a slide storage cavity within which the vertically stacked slides are encapsulated. The lowermost of the slides rests upon the floor of the disposable slide case. The floor of the case has an actuator access opening defined therein. Also, one of the side walls of the case has a slide ejection slot defined therein adjacent to the floor. The case is positionable upon the seating platform so that the carrier finger engages the lowermost of the slides. The slide ejection slot is linearly aligned with the slide ejection path. Also, the case is removable from the base so that it may be discarded once the last of the microscope slides has been ejected therefrom.

The invention may be described with greater clarity and particularity by reference to the accompanying drawings.

DESCRIPTION OF THE EMBODIMENT

Figure 1:
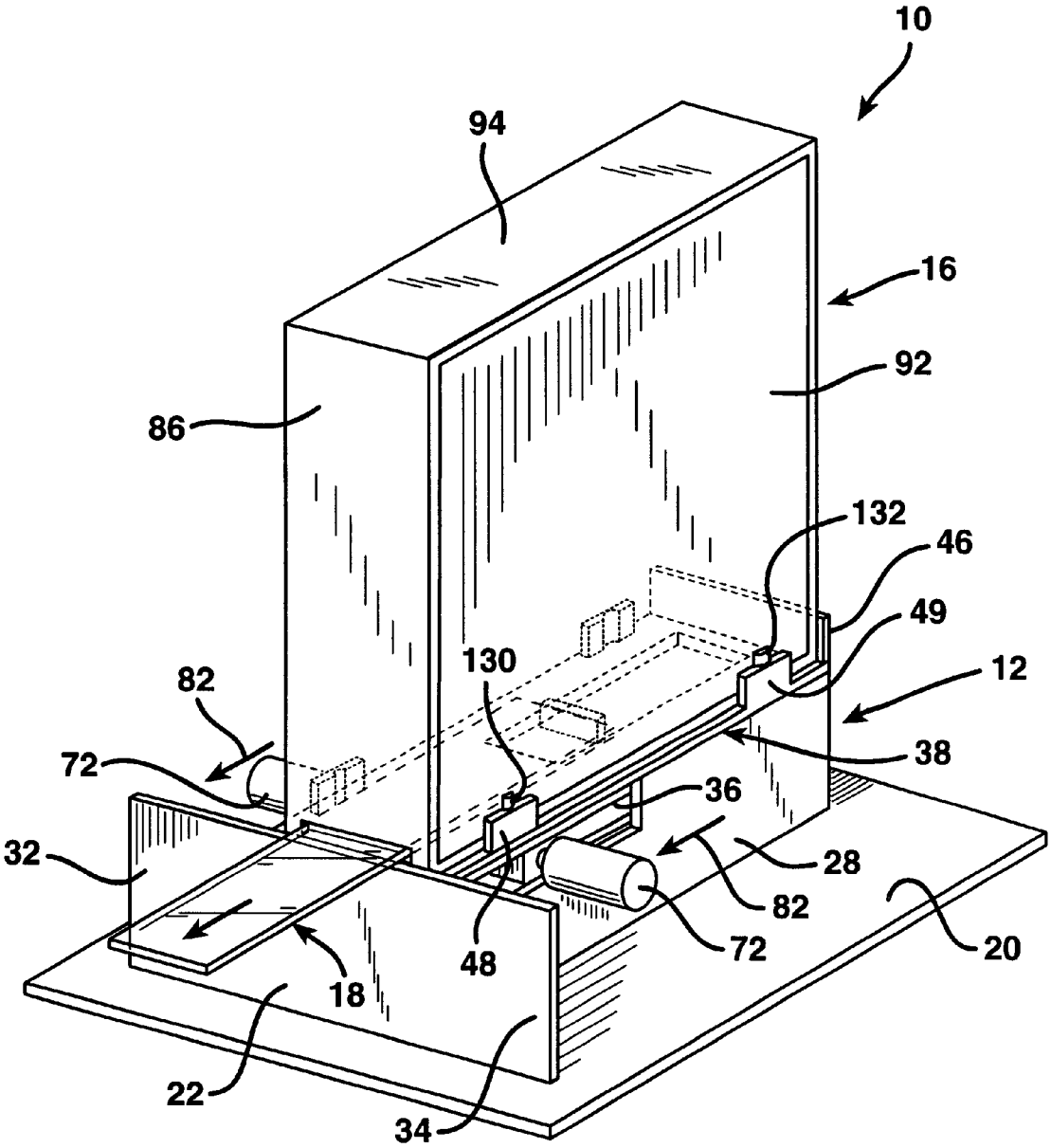
FIG. 1 is a perspective view of one preferred embodiment of a microscope slide dispenser according to the invention.

FIG. 1 illustrates a microscope slide dispenser assembly indicated generally at 10. The slide dispenser 10 is comprised of a hollow dispenser base 12, a slide carrier 14 mounted in the base 12 and best depicted in FIGS. 2, 3, 4, and 5, a disposable slide case 16 mounted atop the base 12, and a plurality of flat, microscope slides 18, best depicted in FIGS. 2, 3, 4, and 5.

The hollow dispenser base 12 is a molded plastic structure formed with a flat floor 20 about four and a half inches in length, about three and a half inches in width, and about one-sixteenth of an inch in thickness. The floor 20 has a central, rectangular opening therein about three and nine-sixteenths inches in length and about one and one-quarter inches in width. This opening is surrounded by upright, rectangular shaped base sides 22, 24, 26, and 28. The base sides 22, 24, 26, and 28 define a cavity therewithin shaped in the form of a rectangular prism.

The lower edges of the base sides 22, 24, 26, and 28 overhang the perimeter of the opening in the floor 20 so as to defme a seating ledge that provides a stop for a flat, rectangular shaped, bottom closure panel 30. The top of the closure panel 30 seats against the seating ledge formed by the lower edges of the base sides 22, 24, 26, and 28. The underside of the bottom closure panel 30 lies flush with the underside of the floor 20. The bottom closure panel 30 can be removed to provide access to the carrier 14, if necessary, but otherwise serves to enclose and protect the operating components of the microscope slide dispenser 10.

The front base side 22 rises from the base floor 20 and extends transversely beyond the lateral base sides 26 and 28 to form a pair of transversely extending wings 32 and 34 that extend outwardly beyond the base sides 26 and 28, respectively. Behind the front base side 22 a pair of horizontally oriented dispenser actuator slots 36 are defined in the lateral base sides 26 and 28. The dispenser actuator slots 36 are defined entirely within the structures of the lateral base sides 26 and 28, but are located only about an eighth of an inch beneath the upper edges of the lateral base sides 26 and 28. The forward ends of the dispenser actuator slots 36 terminate about one-sixteenth of an inch from the front base side 22. The dispenser actuator slots 36 are each about one and five-eighths inches in length and about one-eighth of an inch wide.

The base 12 includes a slide case seating platform 38 that is mounted atop the upper edges of the lateral base sides 26 and 28 and the rear base side 24. The front base side 22 projects above the upper surface of the platform 38 a distance of about one-eighth of an inch to form a forward stop rail 40. The lateral base sides 26 and 28 and the rear base side 24 are thickened at their upper edges to define narrow, inwardly directed lips 42. The edges of the underside of the platform 38 seat upon the upper surfaces of the lips 32 and upon a ledge formed by a notched-out portion near the top of the front base side 22.

The platform 38 is formed with a flat, horizontally disposed panel 44 that is seated atop the lips 42 and on the bearing ledge provided by the notch in the front base side 22 adjacent the stop rail 40. At its rear extremity, the platform 38 has an upright, rear case positioning panel 46 that extends across the rear edge of the panel 44 in perpendicular orientation relative thereto.

The platform 38 also has two pairs of upright, flat, vertically oriented seating lugs 48 and 49 that rise from the upper surface of the panel 44 near the corners thereof and directly above the lateral base sides 26 and 28. Narrow, short, vertically extending grooves 50 and 51 are respectively defined in each of the pairs of seating lugs 48 and 49.

A U-shaped positioning rib 52 is molded onto the underside of the platform 38 and projects downwardly a short distance from the underside of the panel 44 just within the outer perimeter thereof. The positioning rib 52 extends across the rear of the underside of the panel 44 and forwardly therefrom, spaced inwardly a distance of about one-eighth of an inch from the back and side edges of the panel 44. The positioning rib 52 seats snugly within the lips 42 formed at the upper edges of the base sides 24, 26, and 28, and serves to maintain the platform 38 in position directly atop the base 12 so that the side edges and the rear edge of the panel 44 terminate at the outer surfaces of the lateral base sides 26 and 28 and the rear base side 24, and so that the front edge of the panel 44 abuts against the stop rail 40.

Figure 2:
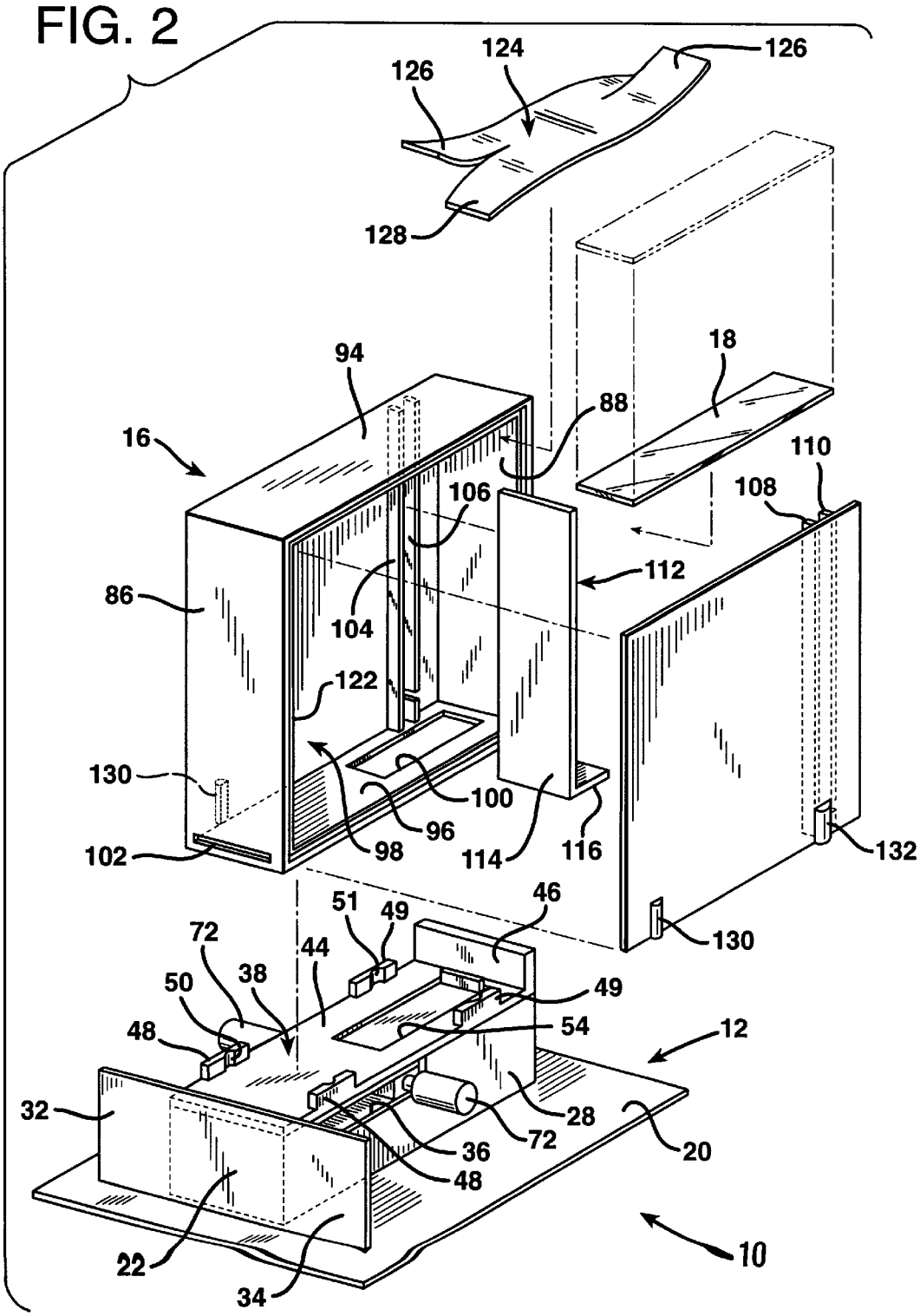
FIG. 2 is an exploded perspective view showing the dispenser of FIG. 1.
Figure 7:
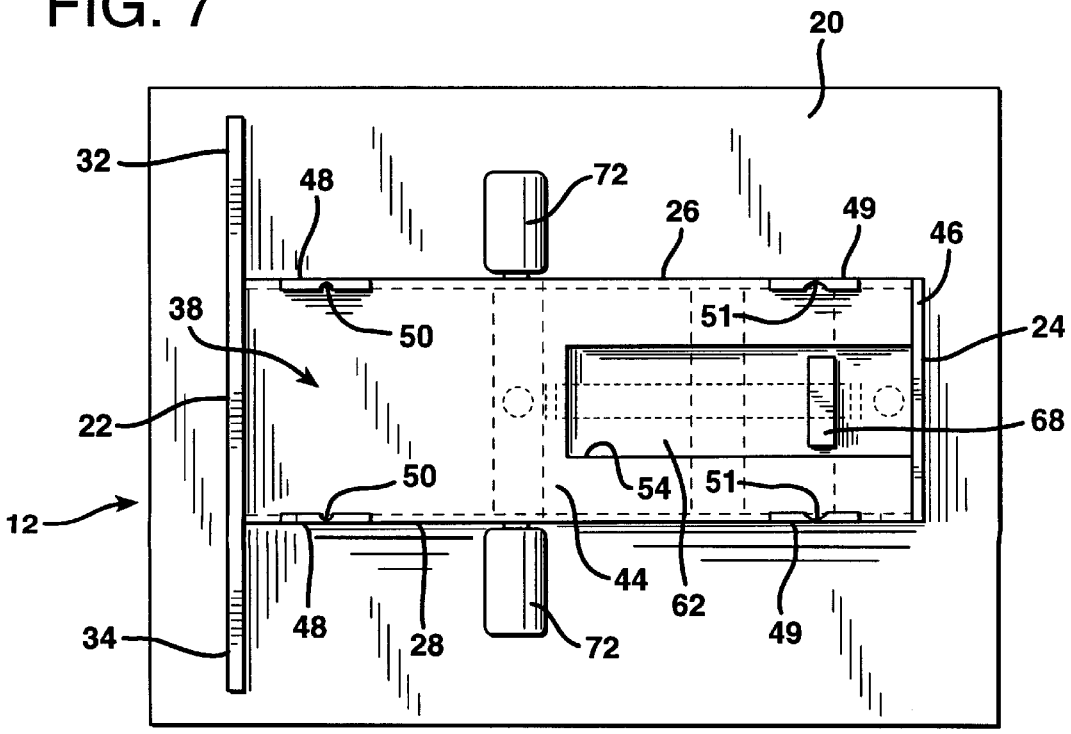
FIG. 7 is a top plan view of the dispenser base of the microscope slide dispenser of FIG. 1.
Figure 8:
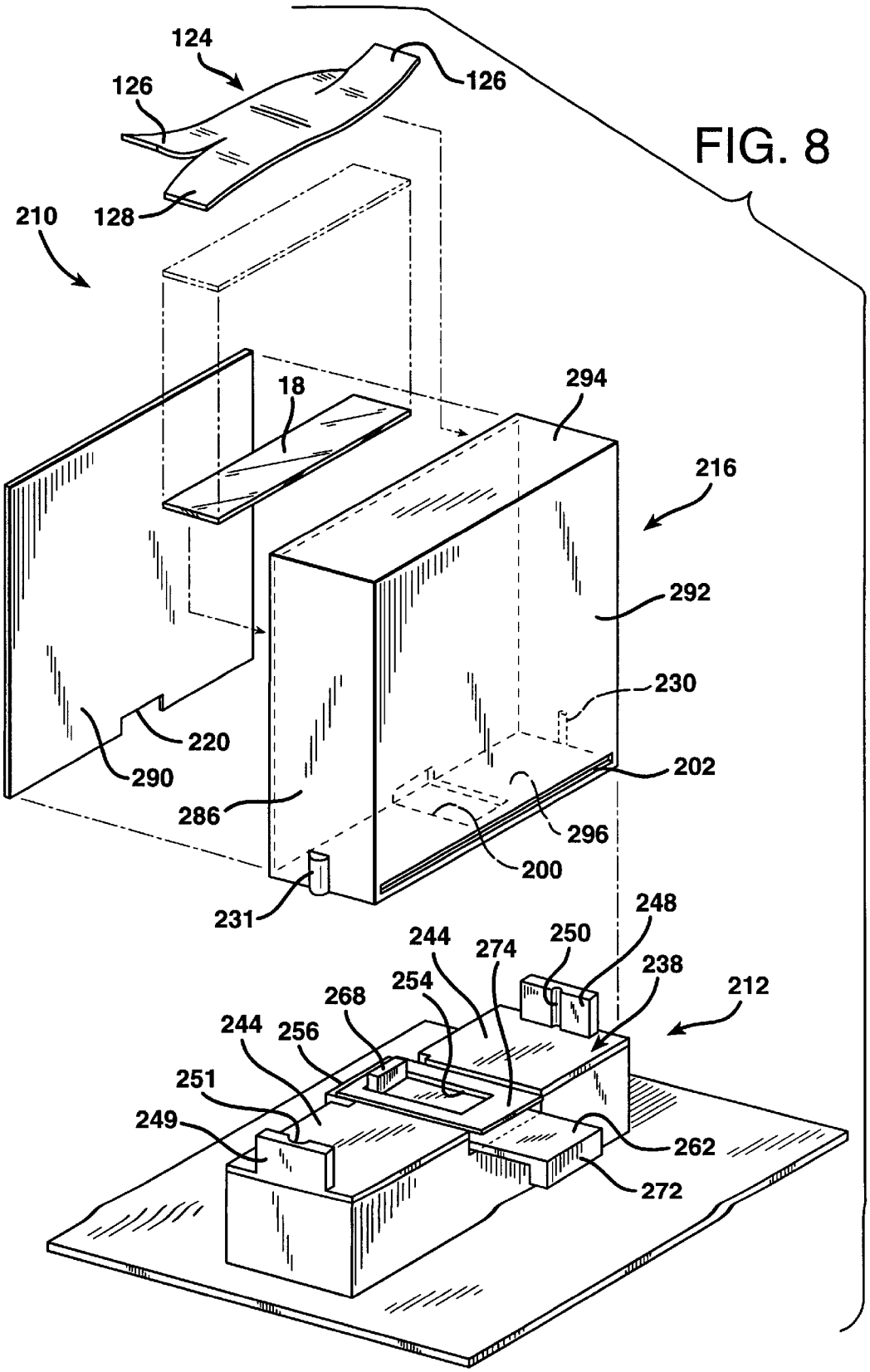
FIG. 8 is an exploded perspective view of one alternative embodiment of a microscope slide dispenser according to the invention.
Figure 9:
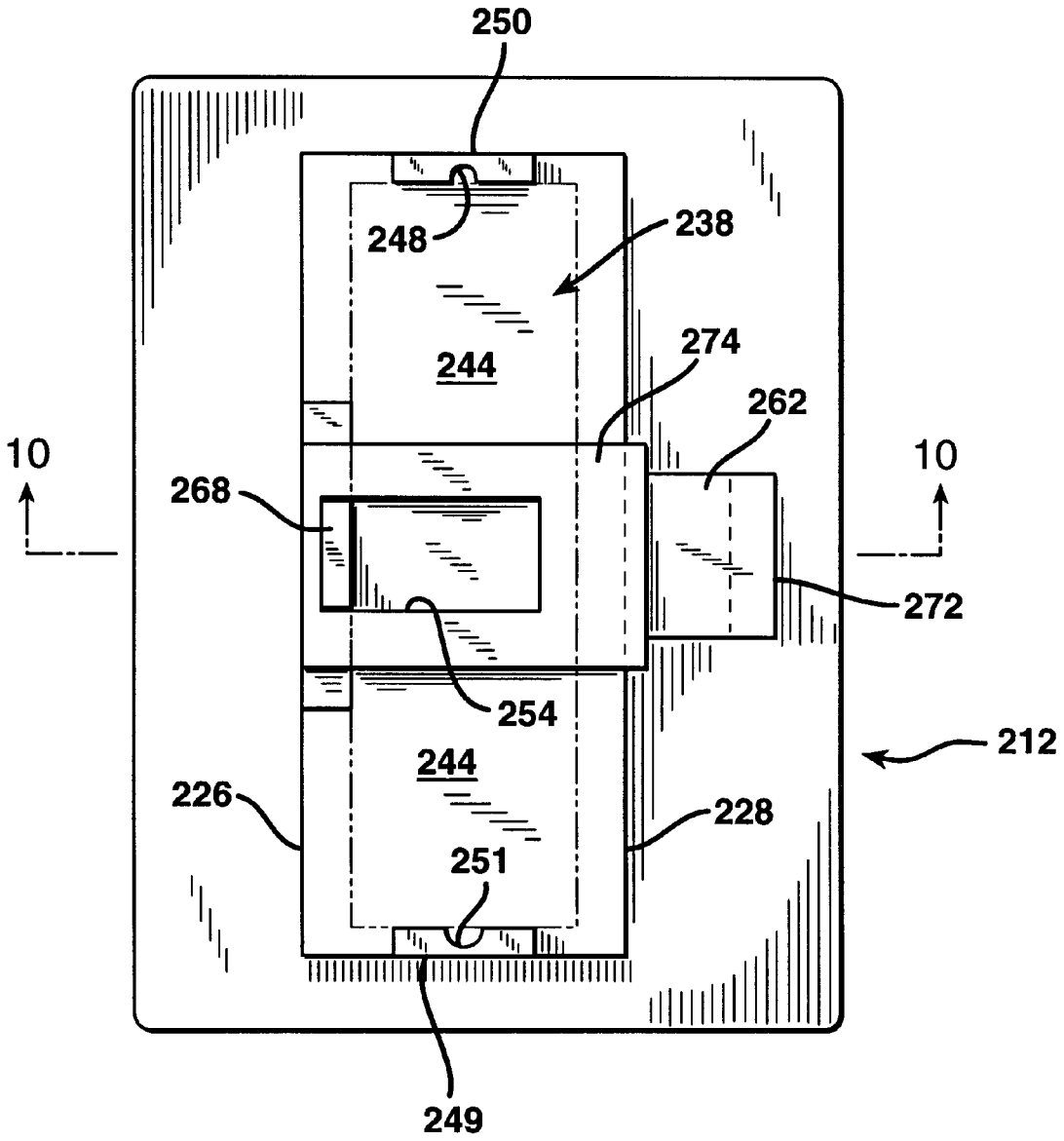
FIG. 9 is a top plan view of the base of the microscope slide dispenser shown in FIG. 8.

As best illustrated in FIGS. 2 and 7, a rectangular carrier finger opening 54 is defined in the platform 38 through the structure of the panel 44. The carrier finger opening 54 is about one and five-eighths inches in length and about nine-sixteenths of an inch in width. The carrier finger opening 54 is centered between the side edges of the panel 44 and terminates about one-sixteenth of an inch from the rear edge thereof.

The slide carrier 14 is best illustrated in FIGS. 2, 3, 4, and 5. A flat, horizontal shelf 56 is formed having a rectangular perimeter about one and five-eighths inches in length and about one and one-eighth inches in width. At its forward edge the shelf 56 is provided with a down-turned, forward, limit ridge 58. Near its rear edge the shelf 56 is formed with a downwardly projecting spring anchoring post 60 having a rearwardly facing spring positioning notch therein.

The width of the horizontal shelf 56 is such that it fits snugly between the lateral base sides 26 and 28 and is secured by friction therebetween in abutment against the undersides of the overhanging lips 42 projecting inwardly thereabove at the upper edges of the base sides 24, 26, and 28. The shelf 56 is thereby secured by glue to the end side 24 and the lateral sides 26 and 28 beneath the platform 38 and in spaced separation therefrom by a distance equal to the thickness of the base ribs 42. If necessary, inwardly facing detent bubbles can be molded on the inwardly facing surfaces of the base sides 26 and 28 just beneath the position of the shelf 56 to aid in holding the shelf 56 in position against the undersides of the lips 42. The shelf 56 is a fixed component of the dispensing mechanism that is anchored to the base 12.

The carrier 14 is comprised of an upper arm 62 shaped generally in the form of a flat, rectangular panel and having a forward end 64 and an opposite rearward end 66. The upper arm 62 is narrower in width than the shelf 56. At its rearward end 66 the upper arm 62 of the carrier 14 terminates in an upwardly projecting slide engaging finger 68. The slide engaging finger 68 is only slightly narrower than the carrier finger opening 54 in the platform 38 and projects upwardly therethrough and extends a short distance above the level of the platform panel 44. Near the forward extremity of the forward end 64 the upper arm 62 is provided with a downwardly projecting spring anchoring post 80 having a forwardly facing spring positioning notch defined therein.

The forward end 64 of the upper carrier arm 62 is enlarged and is provided with a flat, transversely extending stabilizing plate 69 depending therefrom. The carrier 14 also includes a pair of transversely extending actuator handle rods 70 that project outwardly through the dispenser actuator slots 36 from the forward end 64 of the upper arm 62. Once the carrier 14 has been installed in the base 12, cylindrical actuator handle knobs 72 are mounted on the distal ends of the actuator handle rods 70.

The carrier 14 also includes a lower arm 74 which has the shape of a flat, generally rectangular plate, also formed of plastic. The lower arm 74 also has a forward end 76 and a rearward end. The rearward end of the lower arm 74 is turned upwardly to form a transversely extending, upwardly projecting spacer ridge 78 that contacts the underside of the shelf 56. By the same token the downwardly projecting ridge 58 at the forward end of the shelf 56 rides in contact against the upper surface of the lower arm 74 as the carrier 14 travels in reciprocal movement relative to the stationary base 12. The ridges 58 and 78 serve to maintain the lower arm 74 in a horizontal plane parallel to the horizontal plane in which the shelf 56 is mounted relative to the sides of the base 12.

Near its forward end 76, the lower arm 74 is provided with a small, circular opening that snugly receives the spring anchoring post 80 projecting downwardly from the forward end 64 of the upper arm 62. The opening in the lower arm 74 is located so that when the anchoring post 80 is aligned with it, the straight, transverse forward edge of the forward end 76 of the lower arm 74 resides in bearing relationship against the stabilizing plate 69 that depends from the forward end 64 of the upper arm 62. The abutting relationship between the forward edge of the lower arm 74 and the stabilizing plate 69 ensures that the upper arm 62 and the lower arm 74 cannot rotate relative to each other.

By inserting the spring anchoring post 80 through the opening in the lower arm 74, the upper arm 62 and the lower arm 74 are joined together with glue at their respective forward ends 64 and 76 in mutually parallel, horizontal alignment. The arms 62 and 74 respectively reside above and beneath the shelf 56. The smooth undersurface of the upper arm 62 to the rear of the forward end 64 thereof slides easily across the smooth upper surface of the shelf 56. The spacer ridges 58 and 78 respectively slide against the smooth upper surface of the lower arm 74 and the smooth undersurface of the shelf 56. Both of the carrier arms 64 and 74 are thereby maintained in mutually parallel and horizontal alignment.

Figure 4:
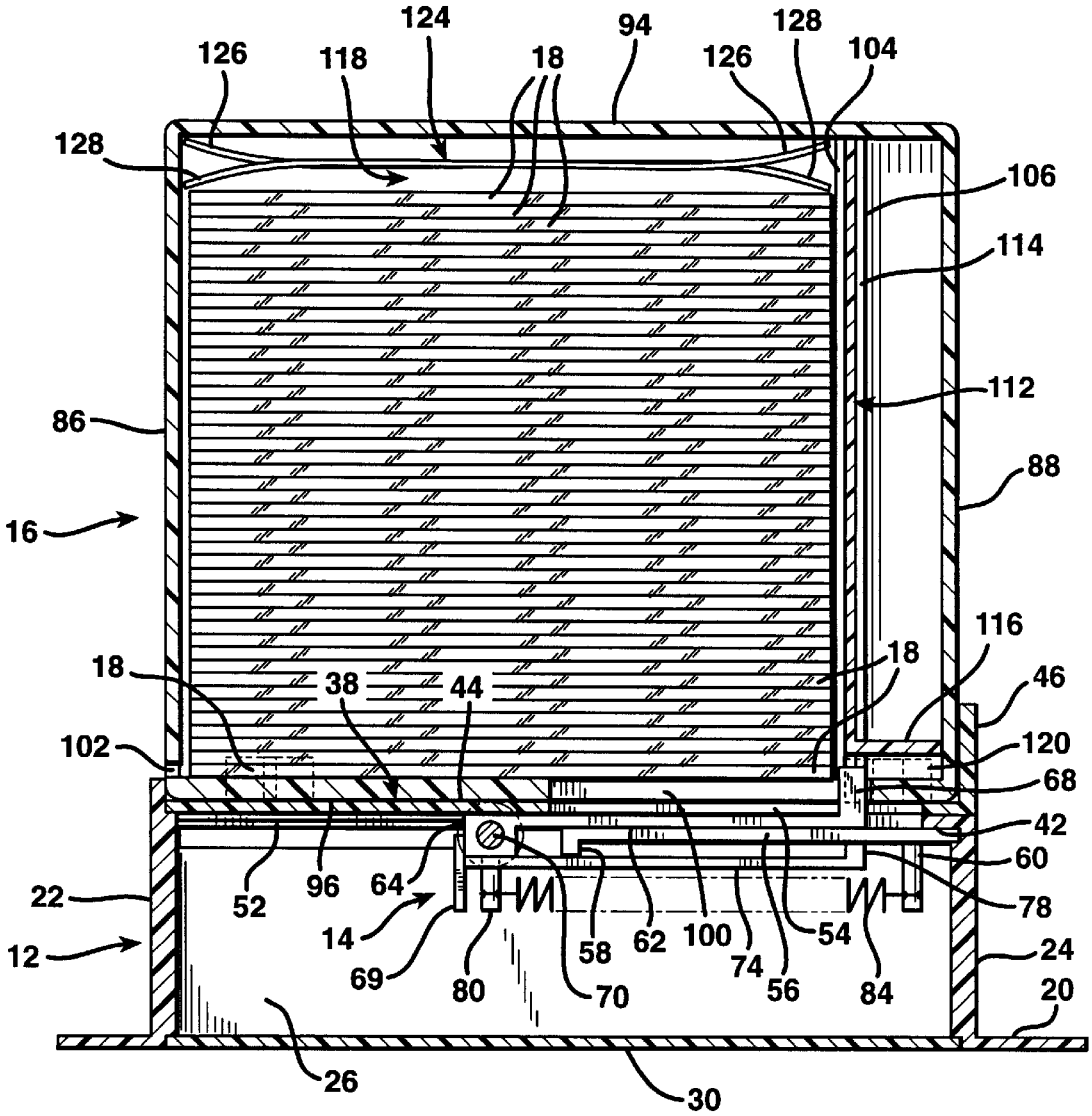
FIG. 4 is a side sectional elevational view of the dispenser of FIG. 1 shown with the disposable slide case seated upon the dispenser base and with the carrier of the dispenser in the return, slide engaging position.
Figure 5:
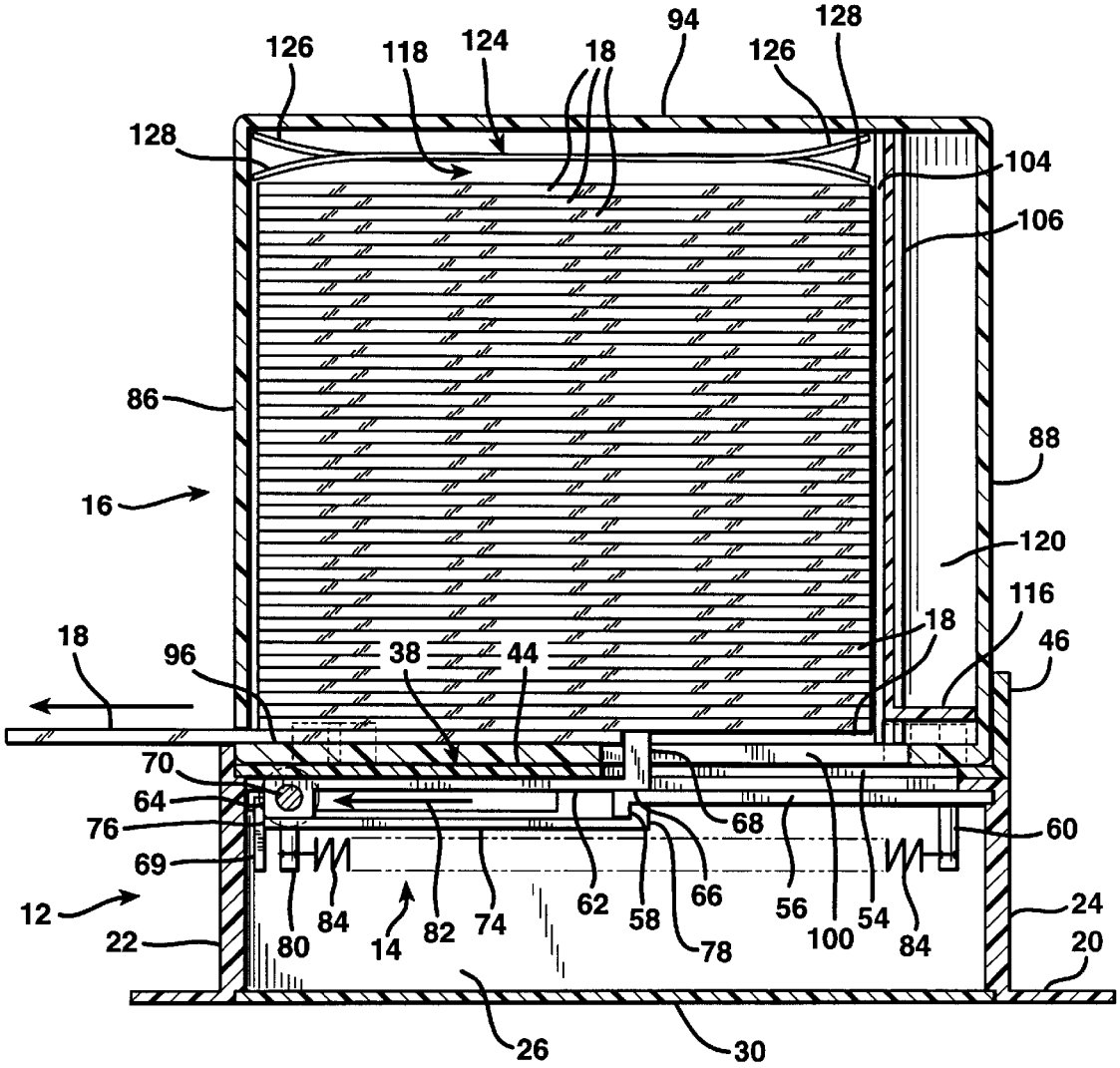
FIG. 5 is a side sectional elevational view of the dispenser of FIG. 1 assembled as in FIG. 4 and shown with the slide carrier in the actuated, slide dispensing position.
Figure 6:
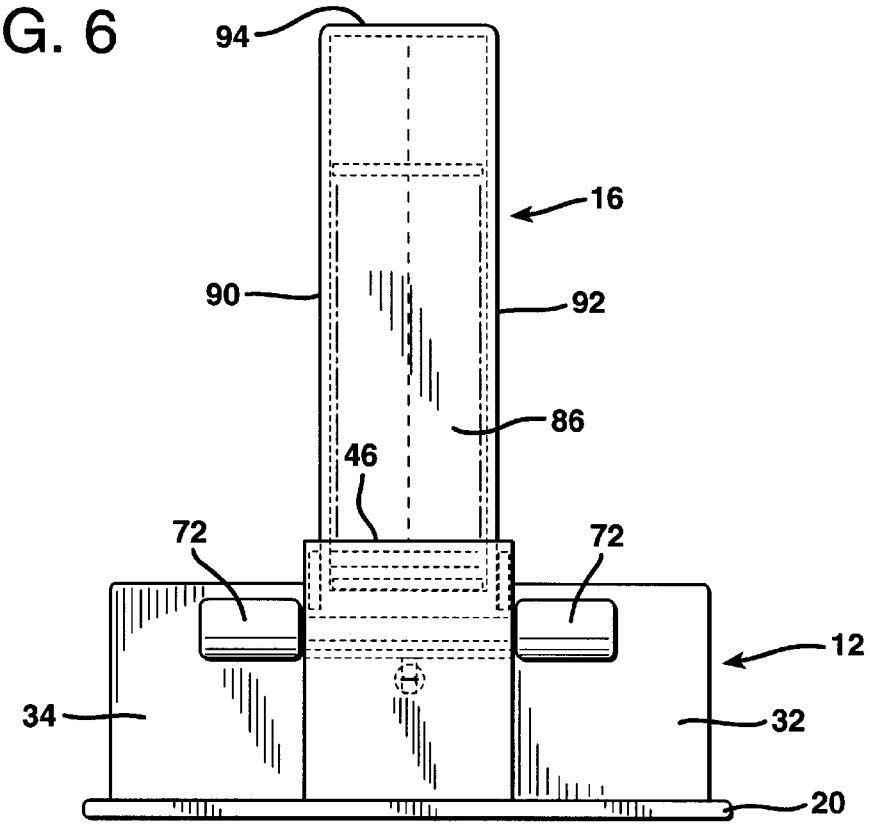
FIG. 6 is a rear elevational view of the dispenser of FIG. 1.

As illustrated in FIGS. 4 and 5, the carrier finger 78 travels in longitudinal reciprocation along a prescribed, horizontal, linear slide ejection path indicated by the directional arrow 82 in FIG. 5. In travelling along the slide ejection path 82, the carrier finger 78 moves between a rearward, return, slide engaging position, depicted in FIG. 4, and a forward, advanced slide ejection position, depicted in FIG. 5.

The actuator handle rods 70 extend from the first, forward ends 64 of the upper carrier arm 62. The actuator handle rods 70 are oriented perpendicular to the arms 62 and 74 and extend through the dispenser actuator slots 36 on the opposite sides of the base 12. The arms 62 and 74 and the actuator handle rods 70 of the carrier 14 and the shelf 56 and the dispenser actuator slots 36 of the base 12 together form a track mechanism to hold the carrier finger 78 at a fixed elevation relative to the base floor 20 as the carrier finger 78 travels in its prescribed, horizontal path 82, and at a fixed elevation relative to the floor of the slide case 16.

Figure 3:
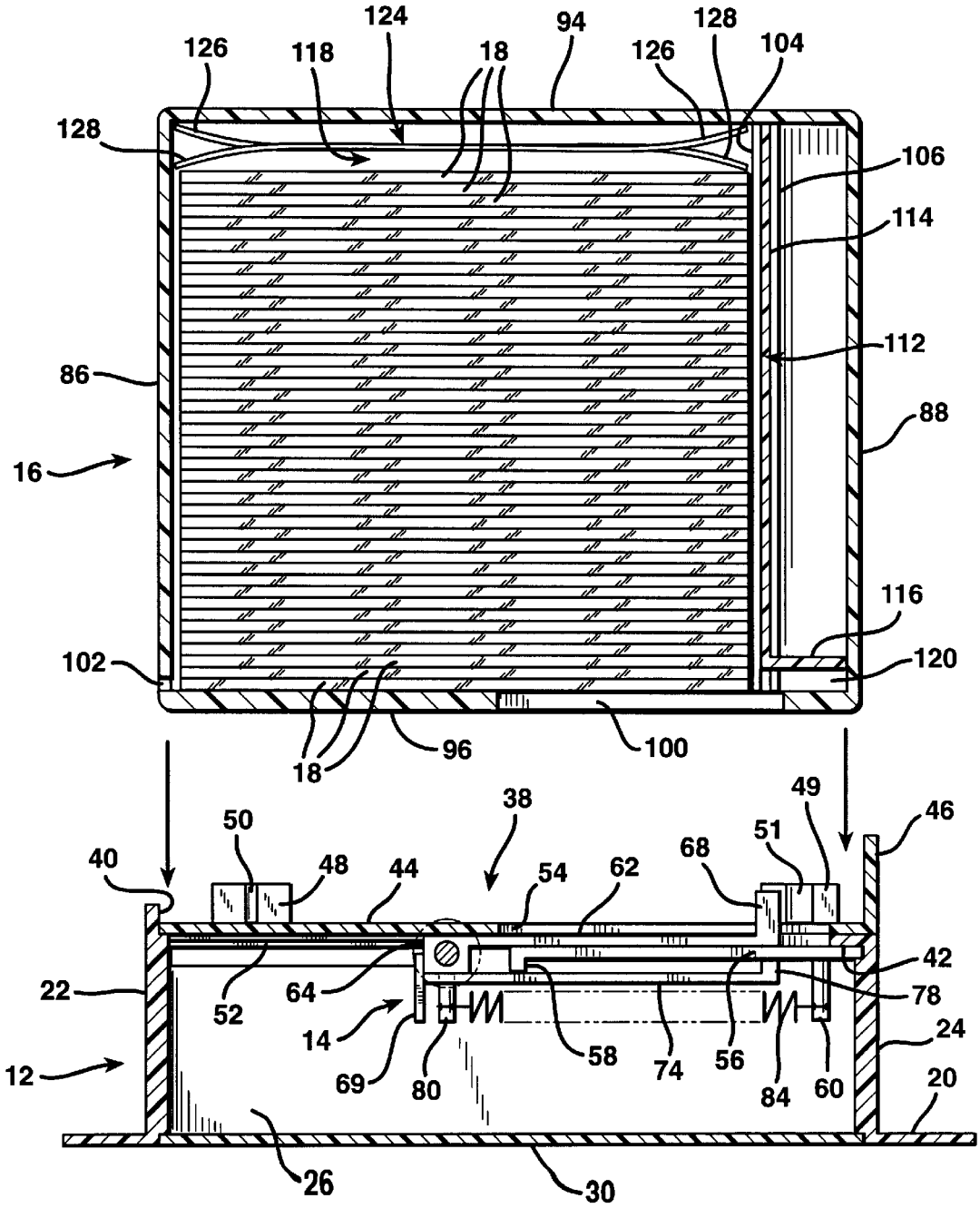
FIG. 3 is a side sectional elevational view of the microscope slide dispense of FIG. 1 showing the disposable slide case separated from the dispenser base.

The slide engaging finger 68 of the carrier 14 is biased toward its return position by the coil spring 84 shown in FIGS. 3, 4, and 5. The coil spring 84 is mounted in tension beneath the actuator 14. The forward end of the coil spring 84 is hooked about the spring anchoring post 80 that projects downwardly from the forward end 64 of the upper carrier arm 62 beneath the lower carrier arm 74 at the forwardly facing notch therein. Similarly, the rear end of the spring 84 is hooked in the rearwardly facing notch of the stationary anchoring post 60 that projects downwardly from the shelf 56. The spring 84 is thereby housed within the base 12 and acts between the carrier 14 and the base 12 to bias the slide engaging finger 68 to its return position shown in FIGS. 3 and 4.

The slide case 16 has a first pair of vertical, mutually parallel, upright side walls 86 and 88, a second pair of mutually parallel upright side walls 90 and 92, a slide case roof 94, and a slide case floor 96. The first and second pairs of upright side walls 86,88 and 90,92 are mutually perpendicular to each other.

The slide case 16 is formed entirely of plastic and is durable enough to serve as a slide shipment and storage box, but economical enough to be considered to be a disposable item. The slide case 16 is preferably about three and one-eighth inches in height, three and five-eighths inches in length and one and three-sixteenths inches in width. The area of the side 90 is slightly smaller than the area of the opposite side 92 to provide a slight draft to the walls 86 and 88 and the roof 94. This draft allows the sides 86 and 88, the roof 94, floor 96, and the side 90 to be molded as a unitary structure. Together the slide case sides 86, 88, 90, and 92, the slide roof 94, and the slide floor 96 form a slide storage cavity indicated at 98 in FIG. 2.

A rectangular actuator access opening 100 is defined in the slide case floor 96. The actuator access opening 100 is approximately one and seven-eighths inches in length and one-half an inch in width, and extends forwardly from near the junction between the slide case floor 96 and the rear, vertical wall 88. At the bottom of the front slide case wall 86 a narrow slide ejection slot 102 is formed immediately adjacent to the slide case floor 96. The slide ejection slot 102 is approximately seven-eighths of an inch in width and one-sixteenth of an inch in height and is of a size just large enough to permit passage therethrough of a single microscope slide 18. Conventional laboratory slides 18 are rectangular in shape and have a standard size of three inches in length, one inch in width, and one-sixteenth of an inch in thickness. Therefore, the slide ejection slot 102 is just barely wide enough and just barely high enough to permit passage therethrough of a single, glass laboratory slide 18 moving in a lengthwise direction as illustrated in FIG. 1.

The slide case 16 is also provided with a divider that extends parallel to and is located remote from the slide wall 86 in which the slide ejection slot 102 is formed. In the embodiment illustrated in FIGS. 1–7, the divider is formed by a pair of vertically extending ribs 104 and 106, molded onto the inside surface of the slide case side 90 and a corresponding, longitudinally aligned pair of ribs 108 and 110 formed on the inwardly facing surface of the opposing slide case side 92. The forwardmost dividing ribs 104 and 108 extend unbroken between the slide case roof 94 and the slide case floor 96. The rearmost dividing ribs 106 and 110 are slotted near their lower extremities, about three-sixteenths of an inch above the slide case floor 96.

The slide case 12 also includes a generally L-shaped partitioning member 112. The partitioning member 112 is configured to form a flat, vertical partition panel 114 that extends between the side walls 90 and 92. The partition panel 114 terminates above the level of the slide engaging finger 68 when the slide case 12 is seated on the slide case platform 38, as depicted in FIG. 4. The partitioning member 112 has a horizontal toe 116 at its lower extremity which is turned rearwardly from the vertical panel 114. The vertical panel 114 of the partitioning member 112 is of a thickness to fit snugly in between the pairs of upright ribs 104,106 and 108,110. The toe 116 projects rearwardly through the slots near the lower ends of the ribs 106 and 110.

Together, the pairs of ribs 104,106 and 108,110 and the partitioning member 112 form a dividing structure that extends parallel to and is located remote from the slide wall 86 in which the slide ejection slot 102 is formed. The divider structure thereby divides the slide cavity 98 into a slide storage compartment 118 bounded on one side by the slide wall 86 in which the slide ejection slot 102 is formed, and a return department 120 remote from the slide wall 86 in which the slide ejection slot 102 is formed.

As illustrated in FIG. 2, the open edges of the slide case sides 86 and 88, the roof 94, and the floor 96 are notched out to form a seating ledge 122. The seating ledge 122 provides a bearing surface against which the inwardly facing surface of the slide case wall 92 rests. The bearing ledge 122 thereby ensures proper seating of the wall 92 relative to the walls 86 and 88, the roof 94, and the floor 96.

Prior to securing the slide case wall 92 in place, the glass microscope slides 18 are arranged in a vertical stack in the slide storage compartment 118 resting atop the floor 96. The length of the slide storage compartment 118 is such that there is a slight, but not unduly large clearance between the forward and rearward ends of the slides 18 and the front slide case wall 86 and the vertical ribs 104 and 108, respectively. Also, although there is a slightly larger gap between the uppermost slide 18 and the roof 94 of the slide case 12, a resilient spacer 124 is located in the slide storage compartment 118 above the stack of microscope slides 18, between the uppermost slide thereof and the roof 94.

The spacer 124 may be formed merely as a plastic strip cut longitudinally at both ends and inelastically deformed, as through heating, to form upwardly and downwardly projecting tabs 126 and 128, respectively, on opposite sides of the structure. The tabs 126 and 128 thereby serve as leaf springs when the slide storage compartment 118 is initially filled with slides 18. Movement of the slides 18 packed within the slide storage compartment 118 is thereby extremely limited by the slide case floor 96, the front wall 86, the resilient spacer 124, and the upright ribs 104 and 108 when the slide case 16 is full. This prevents the slides 18 from moving about and becoming broken within the case 16 during shipment and handling.

Once the stack of slides 18 and the spacer 124 have been inserted into the slide storage compartment 118, the slide case 16 is closed by installing the side 92. The peripheral edges of the side 92 nest into the bearing ledge 122 formed by the open edges of the slide case sides 86 and 88, the roof 94, and the floor 96. Once the side 92 has been seated to close the slide case 16, its peripheral edges are sonic welded to permanently seal the slide case 16 shut. The slide case side walls 86, 88, 90, and 92, the roof 94, and the floor 96 are thereupon all permanently fastened to each other to form the hollow slide cavity 98, which is shaped as a rectangular prism.

To prevent contamination of the slides 18 through the actuator access opening and the slide ejection slot 102, a length of tape is preferably applied onto the outer surface of the floor 96 and extends a short distance up the front wall 86. The tape thereby temporarily covers the actuator access opening 100 and the slide ejection slot 102 during transportation, handling, and storage. Once slides are required for use, however, the strip of tape is removed, thereby uncovering the slide ejection slot 102 and the actuator access slot 100. Alternatively, contamination may be prevented by wrapping the entire slide case 16 in a cellophane or polyethylene wrapper that is removed prior to mounting the slide case 16 on the base 12.

Near their lower edges, the side walls 90 and 92 are provided with a pair of short, outwardly projecting, mutually parallel vertical ribs 130 and 132. The ribs 130 and 132 are preferably of a slightly different cross-sectional configuration. In the embodiment illustrated in FIGS. 1–7, the ribs 130 and 132 are all formed with a semicylindrical cross section, but the ribs 132 have a larger diameter then ribs 130. As a result, the ribs 132 will fit within the larger grooves 51 formed in the upstanding positioning lugs 49 at the rear of the platform 38, but not within the narrower grooves 50 formed in the positioning lugs 48 near the front of the platform 38. It is therefore not possible for a user to position the slide storage case 16 backwards atop the platform 38.

As is evident is FIGS. 2, 3, and 4, the positioning lugs 48 and 49 with the grooves 50 and 51 defined respectively therein, interact with the positioning ribs 130 and 132 on the sides 90 and 92 of the slide storage case 16 to properly seat the slide case 16 atop the seating platform 38 and restrain the slide case 16 from horizontal movement relative to the base 12. The lugs 48 and 49 serve as seating devices.

The positioning lugs 48 and 49 are formed as restraining members that project upwardly from the platform 38 to snugly embrace the slide case side walls 90 and 92 therewithin. The vertically oriented, interengageable ribs 130 and 132 and the corresponding grooves 50 and 51 permit relative vertical movement between the slide case 16 and the slide case seating platform 38 and also prohibit relative longitudinal and transverse movement therebetween. The positioning lugs 48 and 49 also serve as case locator members that guide the slide case 16 into a predetermined position in which the lowermost slide 18 residing in contact with the slide case floor 96 is located between the slide ejection slot 102 and the carrier finger 68, as illustrated in FIG. 4. The spring 84 within the base 12 biases the slide engaging finger 68 to a return position on the slide ejection path 82 remote from the slide ejection slot 102 and within the return compartment 120 of the slide case 16.

Once the slide case 16 has been seated atop the seating platform 38 upon the base 12, slides 18 may be dispensed from the slide storage case 16 by operating the actuator handle knobs 72. With the slide case 16 removably positioned upon the platform 38, as depicted in FIG. 4, a user pushers the slide actuator handle knobs 72 forwardly, toward the front wall 22 of the base 12. The wings 32 and 34 at the ends of the front wall 22 provide structures against which a countervailing force may be applied by the user in opposition to the force on the actuator handle knobs 72. That is, a right-handed person will operate the dispenser 10 by placing the right thumb against the outside of the wing 34 and the right index finger against the knob 72 projecting from the base side 28. The user thereupon squeezes to eject a slide. A left-handed person will similarly operate the device 10 from the other side. The stop rail 40 at the upper edge of the front wall 22 aids in preventing any forward movement of the slide case 16 relative to the base 12.

At the start of an ejection stroke, the slide finger 68 is in the position shown in FIG. 4, held in the return compartment 120 of the slide cavity 98 by the bias of the spring 84. It should be noted that the structure is configured so that the slide engaging finger 68 extends upwardly behind the rear edge of the lowermost slide 18, but not above the upper surface thereof, as it is important for the slide engaging finger 68 to engage only the lowermost slide 18 in the stack of slides, and not to contact the end of the next highest slide.

A forwardly directed force is then applied to the actuator handle knobs 72. This force overcomes the bias of the spring 84 and advances the carrier 14 forwardly, toward the front wall 22 of the base 12. The upwardly projecting slide engaging finger 68 pushes the lowermost slide 18 directly out of the slide ejection slot 102. It is not necessary for the carrier to push the microscope slide 18 completely out of the slide storage compartment 118. Rather, it is sufficient if even only about a third of the lowermost slide 18 is pushed out of the slide storage compartment 118 through the slide ejection slot 102, as depicted on FIG. 5.

Once the forward end of the lowermost slide 18 has been exposed, as illustrated in FIGS. 1 and 5, the actuator handle knobs 72 are released. The spring 84 thereupon pulls the carrier 14 rearwardly until the slide engaging finger 68 has been pulled back from the slide storage compartment 118 into the return compartment 120, thus clearing the rear end of the next sequential slide 18 in the stack. The user may then merely grasp the forward portions of the side edges of the lowermost slide 18 and pull it free from the slide case 16. The height of the slide ejection slot 102 is narrow enough so that only the lowermost slide 18 can be pulled through it. Once the lowermost slide 18 has been pulled completely out of the slide storage compartment 118, the next sequential slide in the stack thereupon drops down onto the slide case floor 96 and becomes the next lowermost slide 18.

The slides 18 are dispensed, one after the other, in this same manner. Once all of the slides 18 have been ejected from the slide case 16 through the slide ejection slot 102, the empty slide case 16 is discarded and replaced with a new, disposable slide case 16, fully packed with a stack of slide 18 as illustrated in the drawings. The empty slide case 16 is removed by manually pulling upwardly on it. The base 12 can be secured on a supporting table by means of double sided tape. The positioning ribs 130 and 132 slide respectively out of the grooves 50 and 51, thereby freeing the empty case 16 completely from the base 12 and seating platform 38.

A replacement slide case 16 fully packed with slides 18, as illustrated in the drawings, is then lowered into position as depicted in FIGS. 2 and 3. That is, the positioning ribs 130 and 132 are respectively aligned with the grooves 50 and 51 in the positioning lugs 48 and 49 projecting upwardly from the seating platform 38. The replacement slide case 16 is then lowered into position as illustrated in FIG. 4.

The embodiments of FIGS. 1–7 illustrates a slide case 16 in which the width of the walls 90 and 92 in the second pair of side wall of the slide case 16 is more than twice the width of the walls 86 and 88 in the first pair of side walls. This allows the slides to be advanced longitudinally in a direction parallel to their longest dimension. Other embodiments of the invention are also possible, however.

FIGS. 8 through 11 illustrate an alternative embodiment of a microscope slide dispenser according to the invention, which is indicated at 210. The slide dispenser 210 is provided with a base 212, a carrier mechanism indicated at 214, and a slide storage case 216. The slide dispenser 210 differs from the slide dispenser 10 in that the slide ejection slot 202 is formed in a one of the wide sides 292 of the first pair of sides of the slide case 216, rather than in one of the narrower side walls 286 or 288 in the second pair of sides thereof. As in the microscope slide dispenser 10, the actuator access opening 200 in the floor 296 of the case 216 is a rectangular opening elongated in a direction parallel to the second pair of sides 286 and 288.

In the slide dispenser 210, the slides 18 are ejected by movement in a direction perpendicular to their longest dimension. As a consequence, it is not necessary to divide the slide cavity 298 of the case 216 so as to form a return compartment in addition to a slide storage department. Rather, a rectangular notch 220 is defined in the lower edge of the other side wall 290 in the first pair of side walls of the case 216. The notch 220 is centered between the side walls 286 and 288 in the second pair and is longitudinally aligned with the upwardly projecting slide engaging finger 268 of the carrier 214.

Due to the shorter distance of travel of the carrier finger 268 in the slide dispenser 210, the carrier structure can be simplified. Specifically, a stationary shelf 256 rests atop the upper edge of the side 226 of the base 212. The spring 284 is anchored at one end to a stationary spring engaging post 260 that extends downwardly from the underside of the shelf 256 proximate the side wall 226 of the base 212. The other end of the spring 284 is anchored to a downwardly projecting spring anchoring post 280 that depends from the underside of a moveable carrier member 262.

The forward end of the carrier member 262 is turned downwardly to form a downwardly projecting finger grip 272, while the rear end of the carrier member 262 is turned upwardly to form an upwardly projecting slide engaging finger 268. The moveable carrier member 262 is restrained from above by a generally rectangular cover panel 274 forming a portion of the seating platform 238. The carrier finger opening 254 is formed in the cover panel 274. The extreme lateral edges of the cover panel 274 are secured by adhesive to the lateral edges of the carrier shelf 256. The carrier 262 is thereby trapped between the shelf 256 and the cover 274. The cover 274, in turn, is inserted beneath to the undersides of the marginal edges of the panels 244 of the seating platform 238 on both sides of the cover 274, and is held in position by a U-shaped rib (not visible) similar to the rib 52 in the embodiment of FIGS. 1–7.

Figure 10:
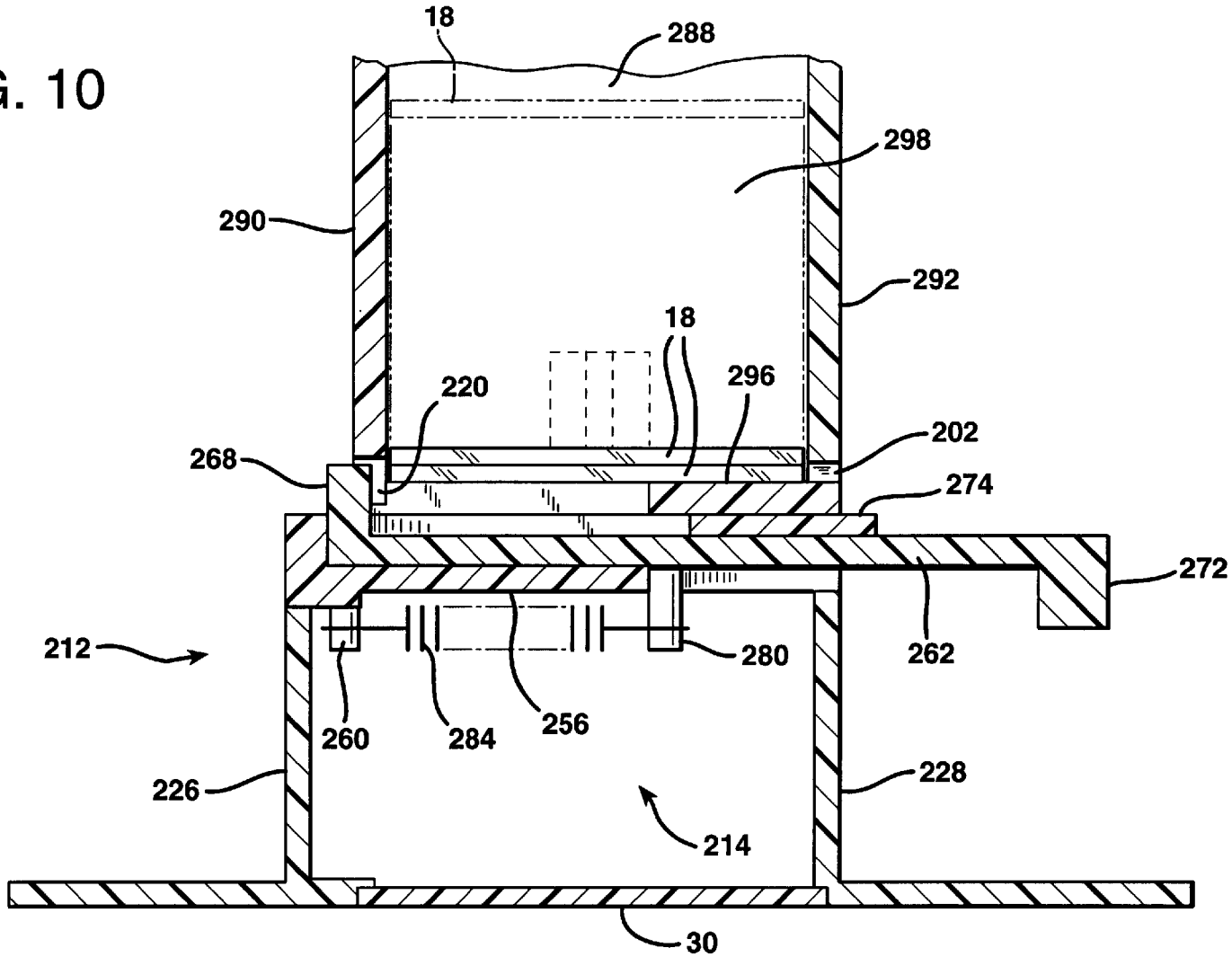
FIG. 10 is a sectional elevational detail taken along the lines 10—10 of FIG. 9 and showing the dispenser mechanism and a portion of the disposable slide case of the microscope slide dispenser of FIG. 8 with the dispenser carrier in its return, slide engaging position.
Figure 11:
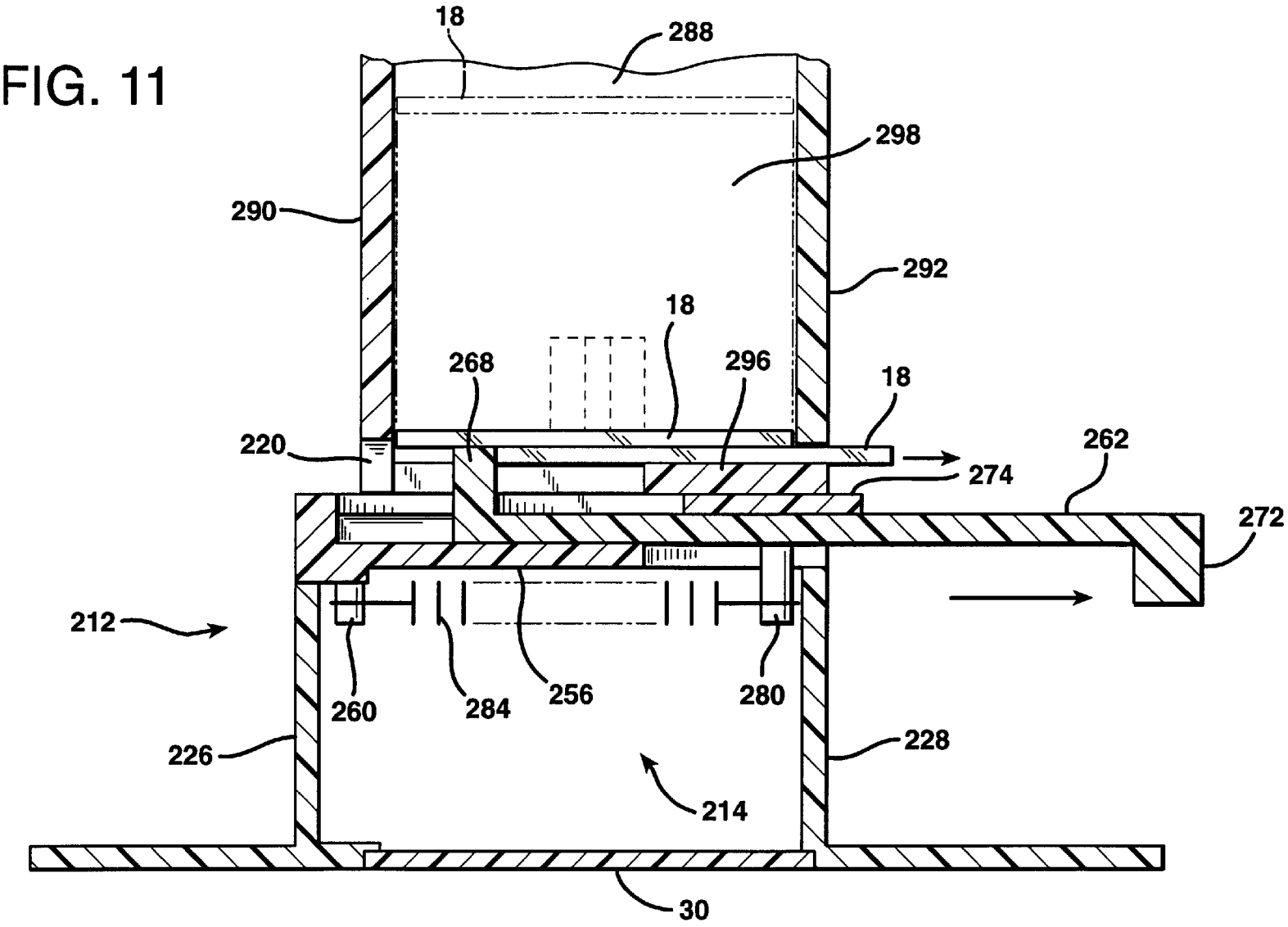
FIG. 11 is a sectional elevational detail taken along the lines 10—10 of FIG. 9 and showing the dispenser mechanism and a portion of the disposable slide case of the microscope slide dispenser of FIG. 8 with the dispenser carrier in its actuated, slide ejection position.

The carrier 262 is thereby trapped beneath the seating platform 238 and is reciprocally moveable between the return, slide engaging position depicted in FIG. 10, and the slide ejection position depicted in FIG. 11. The carrier 262 is operated by means of the finger pull 272 at its forward extremity.

The seating platform 238 includes upright case positioning lugs 248 and 249. Each of the lugs 248 and 249 has an inwardly facing, case positioning groove. The groove 250 has dimensions smaller than the groove 251 so as to accommodate only the rib 230, but not the rib 231 of the case 216. This arrangement prevents the case 216 from being inserted backwards atop the seating platform 238.

In the operation of the slide dispenser 210 illustrated in FIGS. 8–11, the lowermost microscope slide 18 is engaged on its elongated edge remote from the slide dispensing slot 202 by the carrier finger 268, rather than at its narrow edge as in the embodiment of FIGS. 1–7. However, the dispensing action is essentially the same. As each slide 18 is dispensed through the slide dispensing slot 202, and the carrier 262 returns to the slide engaging position illustrated in FIG. 10, the next slide 18 drops down under the force of gravity and becomes the lowermost slide. Once all of the slides 18 have been dispensed through the slide dispensing slot 202, one after the other, the empty slide case 216 is discarded. A replacement slide case 216 fully packed with slides 18, as illustrated in the drawings, is then lowered into position as depicted in FIG. 10.

Undoubtedly, numerous variations and modifications of the invention will become readily apparent to those familiar with the use of microscope slides and devices for handling such slides. For example, positioning pegs rising from the positioning platform and corresponding recesses in the underside of the floor of the slide case could be substituted for the positioning lugs in the embodiments illustrated. Other types of carrier mechanisms could also be employed. Accordingly, the scope of the invention should not be construed as limited to the specific embodiments depicted and described.

I claim:

1. A microscope slide dispenser comprising:

a hollow dispenser base having a floor, a horizontally disposed slide case seating platform that defines a carrier finger opening therethrough and a slide case seat thereatop, base sides supporting said seating platform above said base floor, and at least one horizontally oriented dispenser actuator slot defined in at least one of said base sides, a slide carrier mounted in said base and having a slide engaging finger projecting upwardly through said carrier finger opening in said platform and having at least one actuator handle projecting through said at least one dispenser actuator slot, whereby said slide carrier is mounted for reciprocal movement relative to said base so that said slide engaging finger travels in a prescribed horizontal path between a slide engaging position and a slide ejection position within the limits of said carrier finger opening in said platform and said carrier is advanced by manually forcing said at least one actuator handle relative to said at least one dispenser actuator slot, a disposable slide case having first and second pairs of mutually perpendicular, upright side walls, a slide case roof, and a slide case floor all permanently fastened to each other to form a hollow slide cavity therewithin shaped as a rectangular prism, and wherein an actuator access opening is defined in said slide case floor, and wherein a slide ejection slot is defined in one of said side walls in said first pair of side walls immediately adjacent to said slide case floor, and wherein said slide case is removably seatable on said slide case seating platform such that said actuator access opening in said slide case floor overlies said carrier finger opening in said base platform and such that said carrier finger projects through said slide case floor and into said slide cavity, and a plurality of flat, microscope slides stacked within said slide storage cavity and removable therefrom only through said slide ejection slot by advancement of said carrier.

2. A microscope slide dispenser according to claim 1 wherein said carrier finger opening and said actuator access opening are rectangular openings elongated in a direction parallel to said second pair of side walls and the width of said walls in said second pair of side walls is more than twice the width of said walls in said first pair of side walls, and further comprising at least one vertically oriented slide case divider located proximate to the other side wall in said first pair of side walls, whereby said at least one divider divides said slide cavity into a slide storage compartment that overlies only a portion of said actuator access opening in said slide case floor and only a portion of said carrier finger opening in said platform, and a carrier return compartment that overlies the remaining portions of said actuator access opening and said carrier finger opening, whereby said divider provides clearance above said actuator access opening for said slide engaging finger to travel the entire length of said prescribed horizontal path between said slide engaging position and said slide ejection position.

3. A microscope slide dispenser according to claim 2 wherein said at least one divider includes a flat, vertical partition that extends between said side walls in said second pair of sidewalls and terminates above the level of said slide engaging finger when said slide case is seated on said slide case seating platform.

4. A microscope slide dispenser according to claim 1 further comprising a track mechanism in said base to hold said carrier finger at a fixed elevation relative to said slide case floor as it travels in said prescribed horizontal path.

5. A microscope slide dispenser according to claim 4 further comprising a flat, horizontal shelf secured to said base sides beneath said platform and in spaced separation therefrom, and said carrier is further comprised of an upper arm having a forward end and an opposite, rearward end that terminates in said carrier finger, and a lower arm having a forward end and a rearward end, and said arms are joined together at their forward ends in front of said shelf, whereby said arms extend rearwardly in mutually parallel and horizontal alignment above and beneath said shelf, so that said arms of said carrier and said shelf together form said track mechanism, and said carrier is further comprised of a pair of actuator handles as aforesaid and said base is formed with a pair of dispenser actuator slots as aforesaid, and said actuator handles extend transversely from said first ends of said arms and perpendicular to said arms through said dispenser actuator slots on opposite sides of said base.

6. A microscope slide dispenser according to claim 1 further comprising a spring housed within said base and acting between said carrier and said base to bias said slide engaging finger to said slide engaging position which is remote from said slide ejection slot.

7. A microscope slide dispenser according to claim 1 wherein said slide case seating platform is provided with seating devices that interact with said slide case to seat said slide case atop said seating platform and restrain said slide case from horizontal movement relative to said base.

8. A microscope slide dispenser according to claim 7 wherein said seating devices are formed as restraining members that project upwardly from said platform to snugly embrace said second pair of case side walls therewithin.

9. A microscope slide dispenser according to claim 8 wherein at least some of said restraining members and said second pair of side walls of said case are formed with vertically oriented, interengageable ribs and grooves whereby said restraining members permit relative vertical movement between said slide case and said slide case seating platform and prohibit relative longitudinal and transverse movement therebetween.

10. A microscope slide dispenser according to claim 1 wherein said slide case is formed as a disposable plastic slide shipment and storage box.

11. A microscope slide dispenser according to claim 10 wherein said roof, said floor, and all but a single one of said slide case walls are formed as a unitary, molded structure, and said single one of said slide case walls is permanently secured to said roof, said floor and said other slide case wall once said microscope slides are stacked in said slide storage cavity.

12. A microscope slide dispenser according to claim 1 further comprising a resilient spacer located in said slide storage cavity between said microscope slides and said roof of said case.

13. In a microscope slide dispenser having a base with a dispensing mechanism including a slide engaging finger that projects upwardly from said base and which is movable relative thereto along a slide ejection path, a slide case located atop said base, and a plurality of smooth, flat microscope slides vertically stacked within said slide case, the improvement wherein said slide case is disposable and seats upon and is removable from said base and is formed with confining floor, roof, and side wall members that are permanently sealed together to encapsulate said slides within said slide case with the lowermost of said flat slides in contact with said slide case floor, and said slide case floor has an actuator access opening therein to receive said slide engaging finger in its movement along said slide ejection path, and a slide ejection slot is defined within one of said side wall members immediately adjacent to said floor member and lying in alignment with said slide ejection path, whereby said slide engaging finger is engageable with said lowermost of said slides to eject it from said case through said slide ejection slot as said slide engaging finger moves along said slide ejection path toward said slide ejection slot.

14. A microscope slide dispenser according to claim 13 wherein said slide case encloses a slide cavity and is provided with a divider that extends parallel to and is located remote from said slide wall member in which said slide ejection slot is formed to delineate said slide cavity into a slide storage compartment bounded on one side by said slide wall in which said slide ejection slot is formed and a return compartment remote from said slide wall in which said slide ejection slot is formed.

15. A microscope slide dispenser according to claim 14 further comprising a spring biasing said slide engaging finger to a position on said slide ejection path remote from said slide ejection slot and within said return compartment of said slide case.

16. A microscope slide dispenser according to claim 13 further comprising case retaining members projecting upwardly above said base and said case retaining members seat said slide case in a predetermined position relative to said slide engaging finger and restrain said slide case from horizontal movement relative to said base when said slide case is seated atop said base.

17. A microscope slide dispenser according to claim 13 wherein said slide case is formed as a disposable plastic slide shipment and storage box.

18. In a combination, a microscope slide dispenser base defining a horizontal seating platform having a carrier finger opening therein, a dispenser mechanism mounted on said slide dispenser base and including a carrier that has a slide engaging finger that projects upwardly from said base through said carrier finger opening in said seating platform and is movable in longitudinal reciprocation along a horizontal, linear slide ejection path, a plurality of smooth, flat microscope slides vertically stacked one atop another, and a disposable slide case having side walls, a roof, and a floor and defining a slide storage cavity within which said vertically stacked, flat slides are encapsulated, with the lowermost of said slides resting upon said floor of said case, and wherein said floor of said case has an actuator access opening defined therein and one of said side walls has a slide ejection slot defined therein adjacent to said floor, and said case is positionable upon said seating platform and said carrier finger engages said lowermost of said slides and said slide ejection slot is linearly aligned with said slide ejection path, and said case is removable from said base.

19. A microscope slide dispenser according to claim 18 wherein said seating platform is provided with case locator members that guide said slide case into a predetermined seating position in which said lowermost slide is located between said slide ejection slot and said carrier finger.

* * * * *